US005562250A

United States Patent [19]

O'Neill

[11] Patent Number: 5,562,250

[45] Date of Patent: Oct. 8, 1996

[54] MULTIPLE COMPONENT MIXING TRIGGER SPRAYER

[75] Inventor: Richard K. O'Neill, Wrightwood, Calif.

[73] Assignee: Contico International, Inc., St. Louis, Mo.

[21] Appl. No.: 357,441

[22] Filed: Feb. 13, 1995

[51] Int. Cl.[6] ..... B05B 7/04; B05B 7/12; B05B 9/043

[52] U.S. Cl. ..... 239/304; 239/333; 222/136

[58] Field of Search ..... 239/304, 333, 239/398; 222/136, 144.5, 383.1

[56] References Cited

U.S. PATENT DOCUMENTS

| | | | |
|---|---|---|---|
| 336,846 | 6/1993 | Proctor | D23/213 |
| 3,760,986 | 9/1973 | Castner et al. | 239/304 X |
| 3,966,089 | 6/1976 | Klingaman | 222/88 |
| 4,355,739 | 10/1982 | Vierkötter | 222/134 |
| 4,765,510 | 8/1988 | Rende | 222/79 |
| 4,826,048 | 5/1989 | Skorka et al. | 239/304 X |
| 4,902,281 | 2/1990 | Avoy | 604/191 |
| 5,009,342 | 4/1991 | Lawrence et al. | 222/136 |
| 5,152,431 | 10/1992 | Gardner et al. | 222/136 |
| 5,152,461 | 10/1992 | Proctor | 239/304 |
| 5,169,029 | 12/1992 | Behar et al. | 222/1 |
| 5,332,157 | 7/1994 | Proctor | 239/304 |
| 5,339,990 | 8/1994 | Wilder | 222/135 |
| 5,398,846 | 3/1995 | Corba et al. | 222/1 |

FOREIGN PATENT DOCUMENTS 598237 5/1994 European Pat. Off. .

*Primary Examiner*—Lesley D. Morris
*Attorney, Agent, or Firm*—Howell & Haferkamp, L.C.

[57] ABSTRACT

A trigger sprayer apparatus for use with a container having multiple compartments, the apparatus having a pump for drawing liquid from the container compartments to the pump, wherein check valves prevent liquid from backflowing from the pump to the compartments and the pump has control valves for selecting the mixture ratio of the liquids entering the pump.

23 Claims, 4 Drawing Sheets

MULTIPLE COMPONENT MIXING TRIGGER SPRAYER

BACKGROUND OF THE INVENTION

This invention is directed to the field of spray dispensers. The invention is particularly directed to trigger dispensers, also known as trigger sprayers, having structure for drawing and mixing fluid from containers having more than one compartment.

There are numerous issued patents concerning trigger sprayers capable of dispensing liquid from single compartment containers. Generally, these trigger sprayers are relatively low-cost hand-held pump devices having triggers. The sprayers may be grasped in the hand and the trigger may be pulled to pump liquid from the container and through a nozzle orifice at the front of the sprayer. Typically, trigger sprayers have a dip tube extending from the bottom of the container interior to the trigger sprayer housing so liquid may be drawn from the container. Some type of pump is generally included in the sprayers. These pumps have expandable chambers which draw liquid from the containers as they expand and expel the liquid through the nozzle orifices as they contract. These trigger sprayers also typically have check valves positioned between the dip tube and pump and between the pump and nozzle orifice to assure liquid flows in the appropriate direction through the sprayer. Many of the trigger sprayers also have vent systems to prevent a vacuum from building within the container when liquid is withdrawn. A vacuum will eventually prevent liquid from being dispensed from the sprayer.

Single compartment trigger sprayers work well for most products, however some products have a limited shelf life due to interaction between the components of the product. This highlights a drawback inherent with single compartment trigger sprayers. The various components of the product must be mixed while in the single compartment container which may cause a shortened shelf life. For these products the use of a single compartment container requires that the product be mixed shortly before dispensing. As a result, only small batches of product may be mixed at a time which is an inconvenience.

In addition, some products will not mix together. For instance, if oil and water were placed in a container having a single compartment, the components would separate over time. Since the typical trigger sprayer has a dip tube which extends to the bottom of the container, the component at the bottom of the container will be dispensed first and when that supply is exhausted the second component will then be dispensed. Thus, the consumer must shake the container just before dispensing to achieve a mixture of components of the product. Consumers, however, frequently neglect to shake dispensers before using them thereby producing unsatisfactory results if the components have separated.

Still another problem inherent with the single compartment sprayers is evident under the following circumstances. Sometimes, a concentrated mixture is used in conjunction with a dilutant, frequently water. Depending upon the application, various concentrations are desired. With a single compartment container trigger sprayer apparatus, concentration variations are only available by remixing the contents of the container. This remixing causes waste and inconvenience for the consumer.

Thus, several multiple compartment trigger sprayers have been invented. For instance, U.S. Pat. No. 5,152,431 of Gardner et al. discloses a trigger sprayer with a multiple compartmented container. A separate dip tube extends into each of the compartments and the sprayer is rotatable so that it can alternately be aligned with any one of the dip tubes at a time. Thus, different products are available depending upon which dip tube is selected. However, variable mixture ratios of the products are not available. Also, it is not possible to simultaneously dispense two components without premixing them.

U.S. Pat. No. 4,355,739 of Vierkötter discloses a dual compartment liquid storage container which may be attached to a typical single dip tube sprayer apparatus to form a trigger sprayer capable of segregated product storage. However, because there are no check valves in the system between the mixing chamber and dip tubes, the container may permit cross-mixing of the components and reintroduction of the mixed components into the container compartments.

U.S. Pat. No. 5,009,342 of Lawrence et al. discloses a device similar to the Vierkötter device.

SUMMARY OF THE INVENTION

The present invention provides an improved trigger sprayer apparatus comprising a container having more than one compartment so that two separate liquid components of a product may be segregated until ready for use. The two components are drawn from their respective segregated compartments through inlet passages having check valves to prevent cross-mixing between compartments and their components. The components are first mixed in a pump chamber of the sprayer and dispensed through a nozzle orifice. Mixture ratio may be varied by simple control valves positioned at the rear of the pump chamber. The control valves vary the mixture ratio at a constant rate so that the mixture ratio is predictable. A vent system is also included to prevent a vacuum within the compartment containers.

Thus, the problems associated with single compartment sprayers and limited shelf life products are eliminated. In addition, the problems associated with components of the liquid mixture separating prior to dispensing are eliminated. Also, the proper amount of dilutant of a mixture for any application is instantaneously available with the trigger sprayer of the present invention.

These and other features and advantages of the present invention are apparent from the drawings and description to follow.

DETAILED DESCRIPTION OF THE PREFERRED EMBODIMENT

Figure 1:
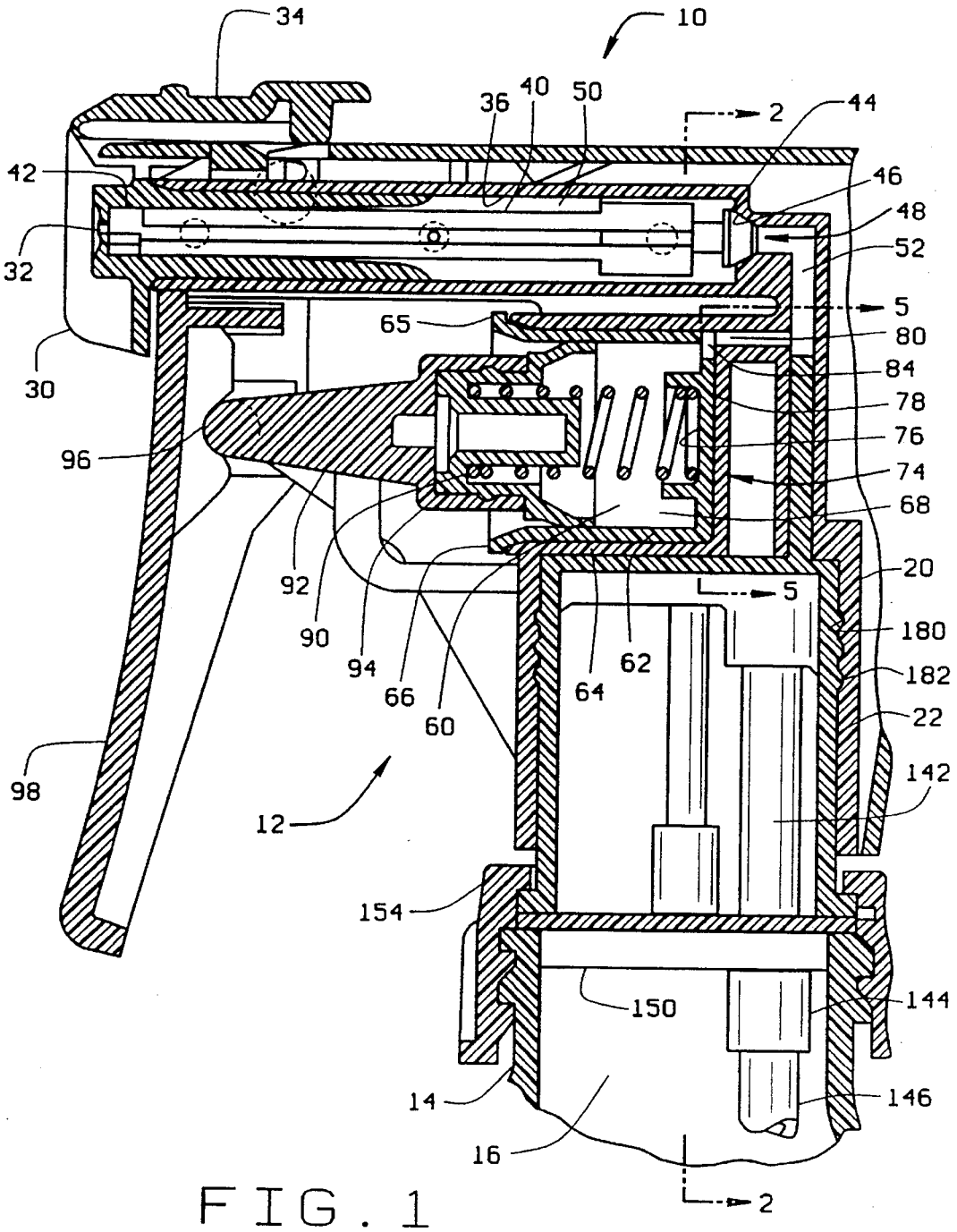
FIG. 1 is a partial, side elevation view in section of the trigger sprayer apparatus of the present invention.

FIGS. 1–7 show the preferred embodiment of the trigger sprayer apparatus 10 of the present invention. The apparatus 10 has a housing 12 connected to a container 14 which has multiple compartments 16 (See FIG. 2). The housing 12 includes a pump chamber housing 20 and a vent chamber housing 22.

A nozzle assembly 30 extends from the forward end of the pump chamber housing 20. The nozzle assembly 30 has an orifice outlet 32 through which the liquid is dispensed. The nozzle assembly also incorporates a hinged sealing door 34 that is closed to prevent leakage from the orifice outlet 32 during shipment and storage. The nozzle assembly 30 is received within a horizontal barrel 36 of the pump chamber housing 20. Also within the barrel is a spinner assembly 40 which includes a spinner head 42 and primary valve body 44. At the rearward end of the barrel is a check valve inlet with a valve seat 46. The primary valve body 44, and the valve seat 46 form a primary valve 48. Liquid can flow forward through the primary valve toward the orifice outlet 32 but is inhibited from flowing rearward through the check valve inlet. The spinner assembly 40 and horizontal barrel 36 form a liquid discharge passage 50 through which the liquid flows from the primary valve 48 to the orifice outlet 32. Behind the valve seat 46 is a liquid outlet passageway 52 which communicates the barrel 36 with a pump chamber to be described later. The liquid discharge passage 50 and the liquid outlet passageway 52 form a passage which communicates the pump chamber with the nozzle orifice outlet 32.

The pump chamber 60 is positioned in the pump chamber housing 20 below the liquid discharge passage 50. The pump chamber includes a pump chamber socket 62 which is formed in the housing 20 below the barrel 36. The pump chamber socket 62 is a cylinder having an open forward end and a panel 78 at the rear end with openings extending through the panel to permit the liquid to enter and exit the pump chamber 60 as will be explained in detail below. A pump cylinder 64 is rotably mounted within the pump chamber socket 62. The pump cylinder 64 is also cylindrically shaped and has an open forward end surrounded by a rim 65 and a panel 76 at the rear end similar to the pump chamber socket 62. The outer diameter of the pump cylinder 64 is slightly smaller than the inner diameter of the pump chamber socket 62. Therefore, the pump cylinder is free to rotate within the pump chamber socket by manually grasping and rotating the rim 65. Openings also extend through the pump cylinder panel. The interrelationship between the pump cylinder and pump socket geometry will become apparent as the function of the parts of the pump chamber are explained in greater detail below. A pump piston 66 reciprocates within the pump cylinder. The pump cylinder and piston define the internal volume 68 of the pump chamber 60. The two overlying panels 76, 78 form a rear wall 74 of the pump chamber. Thus, the pump chamber 60 is comprised of nested inner and outer cylindrical walls 70, 72 extending from a rear wall 74 which is formed of a front panel 76 and rear panel 78. The pump chamber interior volume varies in response to actuation of the trigger sprayer as described below.

Figure 5:
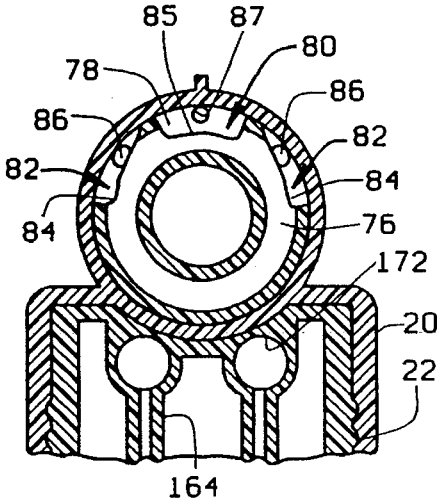
FIG. 5 is a view in section of the trigger sprayer taken in the plane of line 5—5 of FIG. 1.

As best seen in FIG. 5, the wall 74 of the pump chamber 60 has three shaped orifices therethrough. A discharge port opening 80 is centrally located near the top of the wall 74 and a pair of supply port openings 82 lie on each side of the discharge port opening. The supply port openings 82 are comprised of teardrop-shaped first conduit sections 84 in the front panel 76 and circular second conduit sections 86 in the rear panel 78. Each supply port opening 82 communicates with one of a pair of dip tubes yet to be described that extend into the separate compartments 16 of the container. The discharge port opening 80 is comprised of a kidney-shaped opening 85 in the front panel 76 and a circular opening 87 in the rear panel 78. The shape of the opening 85 in the front panel 76 enables the pump cylinder 64 to be rotated through an arc in the pump chamber socket 62 without closing the discharge port opening 80.

A helical return spring 90 is located within the internal volume 68 of the pump chamber and biases the pump piston 66 away from the wall 74. Immediately in front of the pump piston 66 is a rigid plunger 92. A socket 94 in the plunger 92 engages with the forward end of the pump piston 66 to retain the piston in the plunger. On the forward end of the plunger 92 is a knuckle 96 that engages with a trigger 98. The trigger 98 is mounted for pivoting movement on the housing. Pulling and releasing the trigger 98 causes the piston 66 to reciprocate within the pump cylinder 64 to alternately decrease and increase the internal volume 68 of the pump chamber 60 to actuate the trigger sprayer and dispense liquid from the nozzle orifice outlet 32 as will be explained in detail later.

Figure 4:
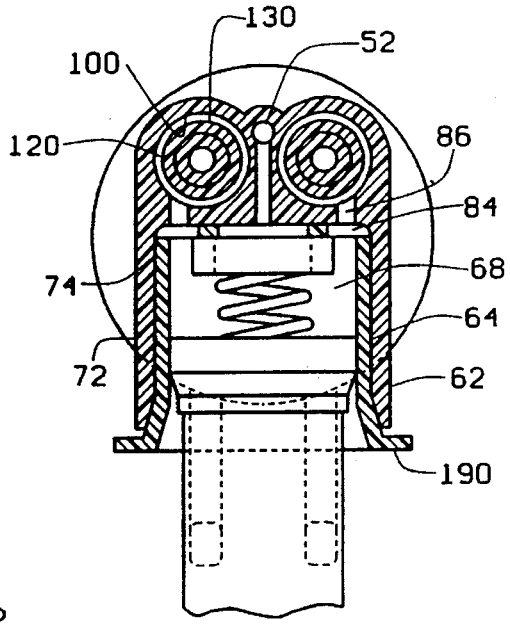
FIG. 4 is a view in section of the trigger sprayer taken in the plane of line 4—4 of FIG. 2.
Figure 3:
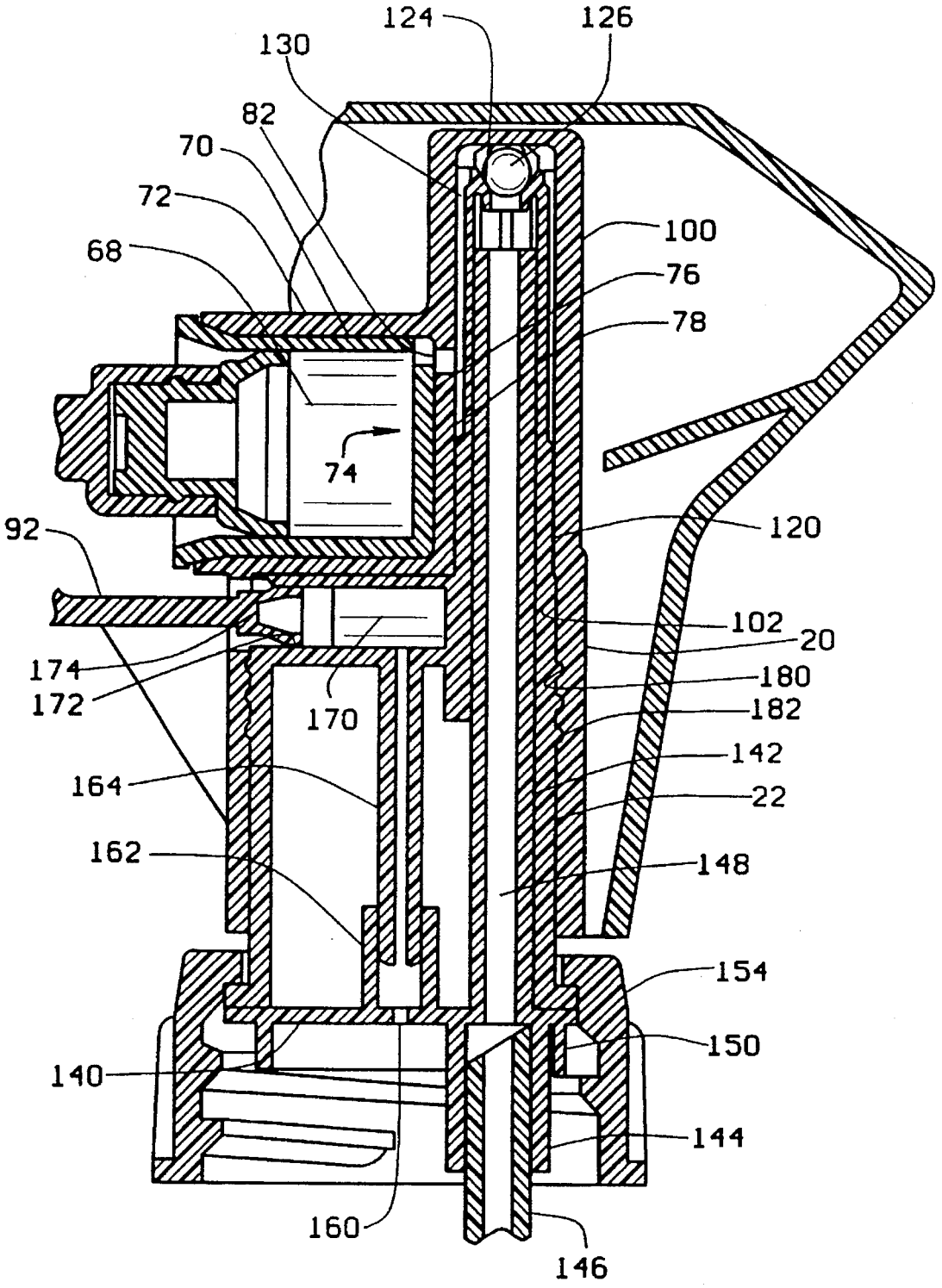
FIG. 3 is a view in section of the trigger sprayer removed from the container taken in the plane of line 3—3 of FIG. 2.
Figure 6:
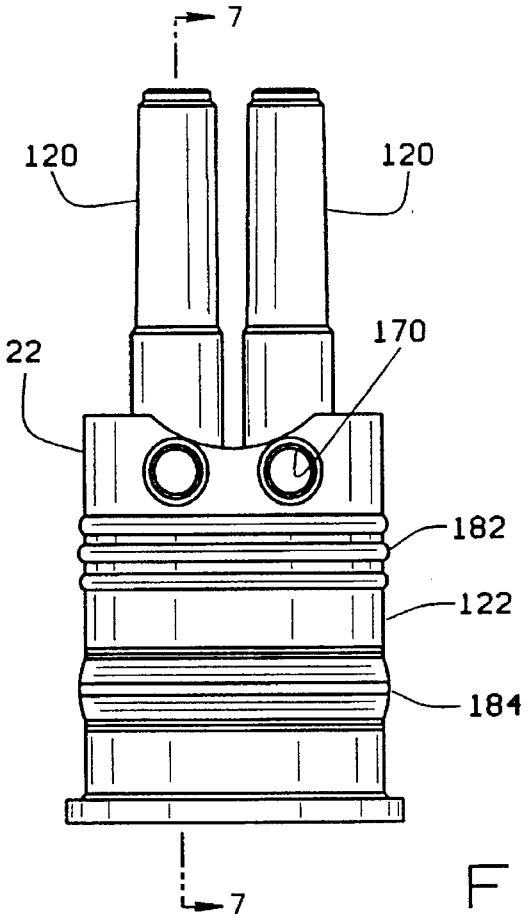
FIG. 6 is a front elevation view of the vent chamber housing used in the trigger sprayer of the present invention.
Figure 7:
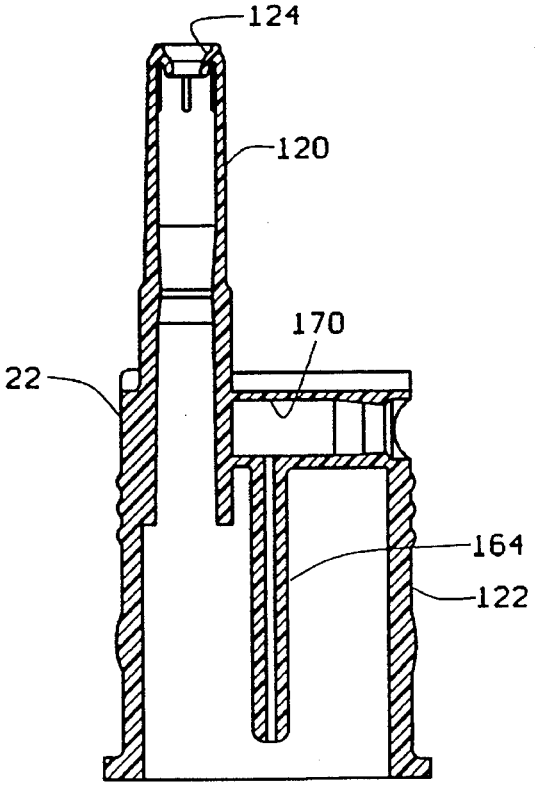
FIG. 7 is a view in section of the vent chamber housing taken in the plane of line 7—7 of FIG. 6.

As shown in FIGS. 3 and 4, immediately behind the supply port openings 82 in the wall 74 of the pump chamber 60 are two fluid supply columns 100 only one of which is shown in FIG. 3. Both of the columns extend upwardly, side-by-side, from a vent chamber housing receptacle 102 formed at the bottom of the pump chamber housing 20. FIGS. 6 and 7 show the vent chamber housing 22 disassembled from the pump chamber housing 20. The vent chamber housing includes two hollow tubes 120 that extend upwardly from a main cylindrical portion 122 of the vent chamber housing 22. Each of the tubes 120 has a valve seat 124 at its upper end. When assembled into the pump chamber housing 20 as shown in FIG. 3, a ball 126 is positioned on the valve seat 124 of each tube 120 and functions as a check valve permitting fluid flow upward through the tube 120 and the valve seat 124, but inhibiting fluid from flowing downward through the valve seat. The tubes 120 have smaller outer diameters than the inner diameters of the fluid supply columns 100 of the pump chamber housing 20 so that two vertical annular passages 130 are formed between the exterior surface of each tube 120 and the fluid supply column 100. The two annular passages 130 extend downward from their two associated valve seats 124 to the two inlet ports 80 of the pump chamber.

A circular cover plate 140 is attached to the bottom of the vent chamber housing 22. The cover plate 140 has two vertical, hollow extension passages 142 that fit in a tight friction sealing engagement inside the two tubes 120 of the vent chamber housing, thereby holding the cover plate to the vent chamber housing. A pair of sockets 144, each communicating with one of the extension passages 142, extend downward from the cover plate 140 opposite the vertical extension passages 142. A pair of dip tubes 146 are fitted in sealed engagement in the pair of sockets 144 and extend downward from the sockets to the bottom of the container compartments 16 so that liquid may be drawn through the pair of dip tubes upon actuation of the trigger sprayer. Together the pair of dip tubes 146, the pair of extension passages 142, and the pair of vertical annular passages 130 form two separate liquid supply passageways 148 which provide fluid communication from the separate compartments of the container to the two supply port openings 82 in the wall 74 of the pump chamber 60.

Figure 2:
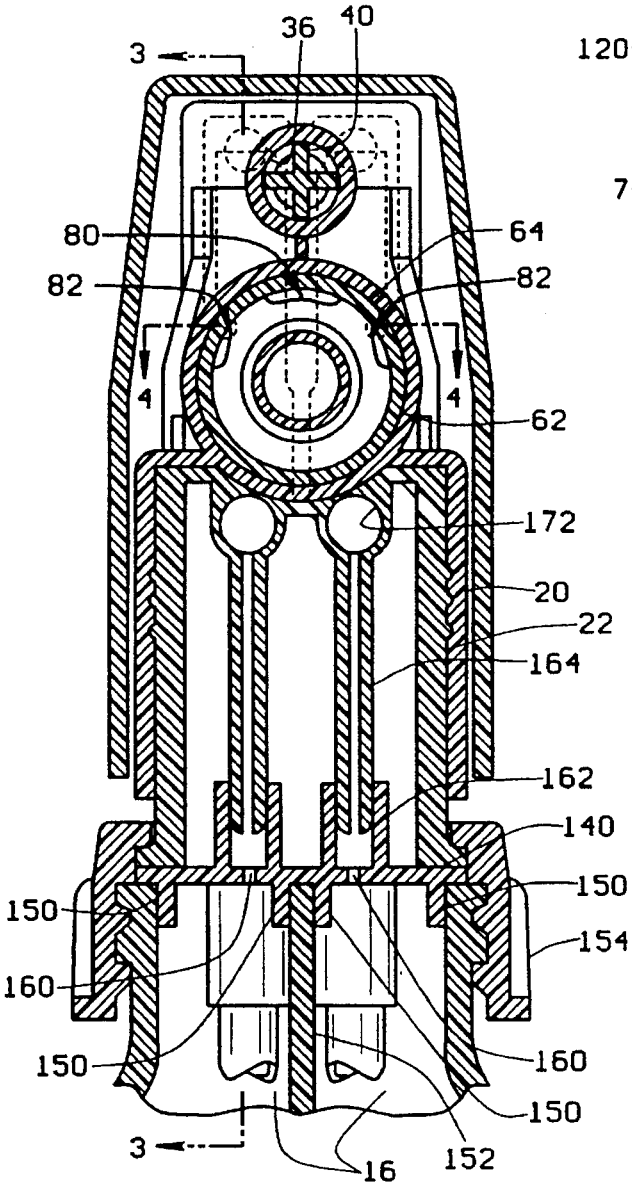
FIG. 2 is a view in section of the trigger sprayer taken in the plane of line 2—2 of FIG. 1.

As best seen in FIGS. 1–3, flanges 150 having a half cylinder configuration depend from the cover plate 140 and engage with the interior surface of the container neck and with the wall 152 separating the container compartments 16. The flanges seal the compartments and prevent leakage from the compartments. A standard trigger sprayer closure 154 is mounted for rotation on the bottom of the vent chamber housing for attaching the trigger sprayer to the container 14.

As shown in FIGS. 2 and 3, two vent ports 160 extend through the cover plate 140 immediately forward of the extension passages 142. Above the vent ports 160 are a pair of sockets 162 which receive two vent tubes 164 formed in the vent chamber housing 22. The vent tubes 164 extend upwardly to two vent chambers 170 integrally formed in the vent chamber housing 22. Each vent chamber 170 is comprised of a horizontal vent cylinder 172 molded into the housing. A pair of vent pistons 174 reciprocate within the vent cylinders 172 to alternately open and close vent passages from the pair of vent chambers 170, through the pair of vent tubes 164, the pair of sockets 162 and the pair of vent ports 160 to the separate interiors of the container compartments to intermittently vent the interior of the container compartments to the exterior of the container. Each vent piston 174 is connected to the plunger 92 which is connected to the pump piston 66 as previously described. Thus, the vent pistons 174 and pump piston 66 are simultaneously activated by pulling and releasing the trigger 98.

Grooves 180 are molded into the pump chamber housing 20 and are configured to receive ridges 182 molded into the main cylindrical portion 122 of the vent chamber housing 22. The mating ridges 182 and grooves 180 retain the vent chamber housing 22 within the pump chamber housing 20 and inhibit disassembly. A ring 184 (See FIG. 6) circumscribes the vent chamber housing 22 below the ridges 182. The ring 184 is sized to be press fitted within the inner diameter of the pump housing receptacle 102 providing a sealed connection between the pump chamber housing 20 and the vent chamber housing 22.

When the trigger is pulled, the pump chamber volume is decreased thereby increasing the liquid pressure within the chamber. The increased pressure causes the ball valves atop the pair of vent chamber tubes 120 to close thereby inhibiting the liquid from traveling down the tubes. The increased pressure also causes the primary valve 44 of the fluid spinner to open, thereby permitting liquid to travel through the liquid discharge passage. As the liquid pressure is increased, liquid is expelled from the pump chamber and directed through the liquid discharge passage 50 and liquid outlet passageway 52 and out the orifice outlet 32. When the trigger is released, the return spring 90 within the pump chamber forces the pump piston 66 forward thereby increasing the volume of the pump chamber 60 and creating a suction in the pump chamber. The suction allows the primary valve 44 of the fluid spinner to seat and close off the primary valve and also opens the pair of ball valves 48 at the tops of the two vent chamber housing tubes 120. The suction draws liquid from the two separate compartments of the container up through the liquid supply passageways 148, and the vent chamber housing tubes 120, past the valve seats 124 and through the pair of annular passages 130 and the pair of supply port openings 82 into the pump chamber.

Each time the pump chamber volume is decreased, the vent pistons 174 move back within their respective vent cylinders and expose the vent passages through the pair of vent tubes 164 to the exterior environment of the container, thereby permitting air to enter the container compartments through the vent passages. Thus, on each trigger stroke, the container compartments are vented to compensate for the liquid removed from the compartments. Therefore, no significant vacuum ever develops which would prevent liquid from being dispensed.

The configuration of the pump cylinder 64 and the supply and discharge port openings 80, 82 enable varying the mixture ratio of the two liquids drawn into the pump chamber from the two separate container compartments. In order to change the mixture ratio of the two liquids drawn into the pump chamber from the separate container compartments, the pump cylinder 64 is rotated within the pump chamber socket 62 using the cylindrical rim 65. Rotation of the rim in opposite directions through a small arc segment varies the size of the exposed openings of the second conduit sections 86 to the pump chamber interior. The teardrop-shaped first conduit sections 84 are symmetrically oriented on the front panel 76 so that as the pump cylinder 64 is rotated in one direction to increasingly expose one of the second conduit sections 86 through its associated first conduit section 84, the other second conduit section 86 becomes increasingly closed or restricted by its associated first conduit section 84. Thus, as the effective entrance area of one supply port opening 82 is increased, the effective entrance area of the other is decreased. Because the effective entrance area of the supply port openings 82 are proportionate to the amount of liquid which may be drawn through the openings from their associated, separate container compartments, the ratio of the two liquids passing through each opening into the pump chamber varies in response to changing the effective entrance areas. Thus, the mixture ratio of the two separate liquids held in the two container compartments passing through the supply port openings 82 changes in response to rotation of the pump cylinder 64 within the pump chamber socket 62 and the relative position of the pump cylinder in the socket. The discharge port opening 80 is kidney-shaped so that the effective area of the discharge port opening remains the same no matter what the effective area of the supply port openings 82.

While the present invention has been described by reference to a specific embodiment, it should be understood that modifications and variations of the invention may be constructed without departing from the scope of the invention defined in the following claims.

What is claimed is:

1. A trigger sprayer apparatus comprising:

a sprayer housing connectable to a pair of separate liquid containing compartments;

a liquid discharge passage within the housing, the discharge passage having opposite ends with a liquid orifice outlet at one end of the discharge passage and a check valve inlet at an opposite end of the discharge passage;

a pump chamber within the housing, the pump chamber having an interior defined at least in part by a pump chamber wall of the housing and the pump chamber having a piston received within the chamber interior for reciprocating movement of the piston therein relative to the pump chamber wall;

a liquid outlet passageway in the housing communicating through the pump chamber wall with the pump chamber interior and extending to the check valve inlet of the liquid discharge passage; and a pair of liquid supply passageways in the housing communicating through the pump chamber wall with the pump chamber interior and extending from the pump chamber wall through the housing and into the pair of separate liquid containing compartments when the sprayer housing is connected to the pair of compartments, the pair of supply passageways conducting flows of at least two separate liquids from the pair of compartments to the pump chamber interior in response to movement of the pump piston relative to the pump chamber wall.

2. The trigger sprayer apparatus of claim 1, further comprising:

means provided on the housing for adjustably varying a rate of liquid flow through at least one of the supply passageways to the pump chamber interior.

3. The trigger sprayer apparatus of claim 2, wherein:

the means for adjustably varying the rate of liquid flow varies the rate of liquid flow in each supply passageway.

4. The trigger sprayer apparatus of claim 1, wherein:

the pump chamber wall has at least a pair of supply port openings therethrough and the pair of supply passageways communicate through the pump chamber wall with the pump chamber interior through the pair of supply port openings.

5. The trigger sprayer apparatus of claim 4, wherein the pair of supply port openings have cross-sectional areas, the trigger sprayer further comprising means in the housing for selectively, manually adjusting the cross-sectional areas of the pair of supply port openings.

6. The trigger sprayer apparatus of claim 4, wherein:

each supply port opening is comprised of juxtaposed first and second conduit sections, the first and second conduit sections of each supply port opening being configured to move relative to each other between a first position where the first and second conduit sections are aligned and the supply port opening is opened, and a second position where the first and second conduit sections are not aligned and the supply port opening is closed.

7. The trigger sprayer apparatus of claim 4, wherein:

the pump chamber wall is comprised of a front panel and a back panel that are movable relative to each other, each supply port opening is comprised of a first conduit section passing through the front panel and a second conduit section passing through the back panel, the front panel being moveable relative to the back panel to move the first and second conduit sections of each supply port opening relative to each other between a first position where the first and second conduit sections are aligned and the supply port opening is opened, and a second position where the first and second conduit sections are not aligned and the supply port opening is closed.

8. The trigger sprayer apparatus of claim 7, wherein:

the first and second conduit sections of the supply port openings are positioned on the front and back panels so that when the first and second conduit sections of one supply port opening are in the first position, the first and second conduit sections of the other supply port opening are in the second position.

9. The trigger sprayer apparatus of claim 8, wherein:

the supply port openings each have a cross-sectional area and the cross-sectional areas are adjusted as the first and second conduit sections of the supply port openings are moved relative to each other.

10. The trigger sprayer apparatus of claim 6, wherein:

the first conduit section of each supply port opening has a cross section with a teardrop configuration and the second conduit section of each supply port opening has a cross section with a circular configuration.

11. The trigger sprayer apparatus of claim 4, wherein:

the pump chamber wall has a discharge port opening therethrough and the liquid outlet passageway communicates through the pump chamber wall with the pump chamber interior through the discharge port opening.

12. The trigger sprayer apparatus of claim 7, wherein:

the pump chamber wall has a discharge port opening therethrough and the liquid outlet passageway communicates through the pump chamber wall with the pump chamber interior through the discharge port opening, the discharge port opening is comprised of a first conduit section passing through the front panel of the pump chamber wall and a second conduit section passing through the back panel of the pump chamber wall, and the first and second conduit sections of the discharge port opening are configured to move relative to each other as the front panel is moved relative to the back panel.

13. The trigger sprayer apparatus of claim 12, wherein:

the discharge port opening has a cross-sectional area that does not vary as the front panel is moved relative to the back panel.

14. The trigger sprayer apparatus of claim 7, further comprising:

a cylindrical wall extension that extends from the front panel and projects from the sprayer housing, the cylindrical wall extension being configured to be manually grasped and rotated to thereby move the front panel relative to the back panel.

15. The trigger sprayer apparatus of claim 14, wherein:

the pump chamber interior is surrounded by the pump chamber wall front panel and the cylindrical wall that extends from the front panel, and the pump piston is received in the pump chamber interior in sliding engagement with the cylindrical wall.

16. The trigger sprayer apparatus of claim 1, wherein:

each liquid supply passageway has a check valve positioned therein intermediate the pump chamber wall and the pair of liquid containing compartments when the sprayer housing is connected to the pair of compartments, the check valves permit flow of the two separate liquids from the pair of compartments to the pump chamber interior and prevent flow of the two separate liquids from the pump chamber interior to the pair of compartments.

17. In combination, a trigger sprayer assembly and container for dispensing a plurality of liquids from the container, the combination comprising:

a container having a plurality of discrete compartments for segregating liquids, the container having a neck;

a trigger sprayer assembly having a housing with an outlet passage therein, the passage having a front end;

a connector secured to the housing for connecting the housing to the neck of the container;

a nozzle positioned at the front end of the outlet passage, the nozzle having an orifice through which a mixture of liquid is dispensed in a selected ratio from each compartment;

a pump chamber within the housing for pumping liquid from the container compartments and dispensing liquid through the orifice in response to actuation, said pump chamber being defined at least in part by a pump chamber wall of the housing;

a plurality of inlet passages communicating each container compartment with the pump chamber through the pump chamber wall;

a plurality of check valves, one of the plurality of check valves mounted within each of the plurality of inlet passages for inhibiting backflow of liquid into the container compartments; and an opening through the pump chamber wall and in fluid communication with the outlet passage so that liquid flowing from the pump chamber and through the outlet passage flows through the opening.

18. The combination of claim 17 further comprising mixture control means for controlling the ratio of the liquids from each compartment that are dispensed.

19. The combination of claim 17 wherein the flow of liquid through the inlet passages is selectively variable to any mixture ratio.

20. The combination of claim 17 further comprising vents for preventing a vacuum in the container compartments.

21. A trigger sprayer apparatus comprising:

a sprayer housing adapted to be connected to a pair of separate liquid containing compartments;

a pump chamber within the housing, the pump chamber having an interior defined at least in part by a pump chamber wall of the housing;

a liquid discharge passage within the housing;

a liquid outlet passageway in the housing, said liquid outlet passageway providing fluid communication between the pump chamber interior and the liquid discharge passage through the pump chamber wall;

a pair of liquid supply passageways for conveying liquid from the liquid containing compartments to the pump chamber wall when the sprayer housing is connected to the pair of compartments;

a first check valve between the liquid discharge passage and the liquid outlet passage configured for permitting liquid flow from the pump chamber interior through the pump chamber wall through the liquid out passage and into the liquid discharge passage and for checking liquid flow from the liquid discharge passage to the liquid outlet passageway;

a pair of second check valves within the liquid supply passageways configured for permitting liquid flow from the liquid containing compartments to the pump chamber and for checking liquid flow from the pump chamber to the liquid containing compartments; and a piston within the pump chamber interior and moveable within the pump chamber interior relative to the pump chamber wall, said piston being configured so that reciprocating movement of the piston within the pump chamber draws liquid from the liquid containing compartments into the pump chamber interior and forces liquid in the pump chamber through the liquid outlet passageway and out the liquid discharge passage.

22. The trigger sprayer apparatus of claim 21 wherein the housing and liquid supply passageways are configured so that liquid flowing from one of the liquid containing compartments to the pump chamber interior passes through the pump chamber wall before mixing with liquid flowing from the other of the liquid containing compartments.

23. The trigger sprayer apparatus of claim 21 wherein one of the liquid supply passageways includes first and second conduit sections, said conduit sections being configured so that movement of the first conduit section relative to the second conduit sections adjustably varies the rate of liquid flow through said one of the liquid supply passageways.

* * * * *